US009334614B1

(12) United States Patent
Zoellner

(10) Patent No.: US 9,334,614 B1
(45) Date of Patent: May 10, 2016

(54) TRAFFIC BARRIER DELINEATOR APPARATUS

(71) Applicant: Jay Zoellner, El Dorado Hills, CA (US)

(72) Inventor: Jay Zoellner, El Dorado Hills, CA (US)

( * ) Notice: Subject to any disclaimer, the term of this patent is extended or adjusted under 35 U.S.C. 154(b) by 0 days.

(21) Appl. No.: 13/831,891

(22) Filed: Mar. 15, 2013

Related U.S. Application Data

(60) Provisional application No. 61/699,837, filed on Sep. 11, 2012.

(51) Int. Cl.
*E01F 15/00* (2006.01)
*E01F 9/011* (2006.01)

(52) U.S. Cl.
CPC ..... *E01F 9/0112* (2013.01)

(58) Field of Classification Search
CPC ..... E01F 13/026; E01F 15/02; E01F 15/08
USPC ..... 404/6, 9, 12, 14; 116/63 R, 63 P; 40/612, 40/606.01; 359/547, 552
See application file for complete search history.

(56) References Cited

U.S. PATENT DOCUMENTS

| | | | | | |
|---|---|---|---|---|---|
| 4,249,832 | A * | 2/1981 | Schmanski | 404/6 |
| 4,502,812 | A * | 3/1985 | Zucker | 404/6 |
| 4,773,629 | A * | 9/1988 | Yodock | 256/13.1 |
| 4,946,306 | A * | 8/1990 | Yodock | 404/6 |
| 4,986,694 | A * | 1/1991 | Delamere | 404/6 |
| 5,498,101 | A * | 3/1996 | Braverman | 404/6 |
| 5,678,950 | A * | 10/1997 | Junker | 404/10 |
| 5,988,934 | A * | 11/1999 | Wasserstrom | 404/6 |
| 6,666,616 | B2 * | 12/2003 | Yodock et al. | 404/6 |
| 6,679,649 | B1 * | 1/2004 | Capolupo | 404/6 |
| 6,718,672 | B1 * | 4/2004 | Wieringa | 40/612 |
| 6,835,023 | B1 * | 12/2004 | Paterson | 404/6 |
| 7,014,389 | B1 * | 3/2006 | Siblik | 404/10 |
| 8,640,370 | B2 * | 2/2014 | Mandl et al. | 40/606.01 |
| 2004/0091315 | A1 * | 5/2004 | Yodock et al. | 404/6 |
| 2004/0197140 | A1 * | 10/2004 | Maleska | 404/6 |
| 2005/0135878 | A1 * | 6/2005 | McNally et al. | 404/6 |
| 2008/0069637 | A1 * | 3/2008 | Mize et al. | 404/9 |
| 2010/0098488 | A1 * | 4/2010 | Huck et al. | 404/14 |

* cited by examiner

*Primary Examiner* — Thomas B Will
*Assistant Examiner* — Katherine Chu
(74) *Attorney, Agent, or Firm* — O'Banion & Ritchey LLP; John P. O'Banion

(57) ABSTRACT

A traffic barrier delineator apparatus configured for being removably placed through a horizontal hole in a traffic barrier is described. The apparatus is made from plastic and is hollow with a retainer that will retain it in the traffic barrier hole. It is collapsible and will bend if hit by traffic. The apparatus is reusable and replaces industry standard adhesively attached traffic barrier traffic markers. This apparatus allows installation in traffic barriers that have screens or panels on top. This apparatus is far more visible to traffic with various reflective configurations and will not be incidentally dislodged during construction activities. Applications include temporary traffic barriers such as K-rails or Jersey rails, where existing horizontal holes allow the apparatus to be quickly slid into without entering live traffic. Traffic barriers with and without horizontal holes can be retrofitted for this apparatus.

11 Claims, 8 Drawing Sheets

TRAFFIC BARRIER DELINEATOR APPARATUS

CROSS-REFERENCE TO RELATED APPLICATIONS

This application is a nonprovisional of U.S. provisional patent application Ser. No. 61/699,837 filed on Sep. 11, 2012, and incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to traffic reflectors, and more particularly to traffic reflectors mounted on traffic barriers.

2. Description of Related Art

Traditional traffic barriers typically have reflectors located on the top of the traffic barrier. Since traditional traffic barriers are wider at their base than at their tops, their geometry leads to vehicle-barrier impacts due in part to errors in perceived distance to the traffic barrier based on the top-mounted reflectors.

BRIEF SUMMARY OF THE INVENTION

Accordingly, an object of the present invention is to provide improved visibility for motorists (especially motorcyclists) with bright colors (e.g. orange) that contrast the traditional white traffic barriers. This would be especially helpful to motorist during periods of inclement weather, providing motorists with a clear target both day and night.

One aspect of the present invention is a self-attaching safety delineator designed to be an economical alternative to the reflective markers that are currently placed on temporary traffic barriers. It is uniquely designed and can provide high visibility guidance for motorists driving adjacent to temporary rail barriers through construction work zones.

Another aspect of the invention is the possibility of cost savings to contractors and State Departments of Transportation as the invention can be reused numerous times over an extended period of time. Additionally, the designed configuration allows for quick installation through existing round holes in currently used temporary traffic barriers. The invention is also designed for quick, secure installation with no adhesive or hardware required which can result in consistent delineation and increased worker safety through construction zones.

In another aspect of the invention, the barrier delineator may extend from one or both sides of the traffic barrier. In the case of the single side barrier delineator, since the apparatus extends to the traffic side, it may be installed from the non-traffic side. This places a worker installing the barrier delineator, whether using a machine or manually, with a traffic barrier disposed between them and vehicular traffic. This would tend to increase worker safety.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWINGS

The invention will be more fully understood by reference to the following drawings which are for illustrative purposes only.

DETAILED DESCRIPTION OF THE INVENTION

Traffic Barriers

Figure 2:
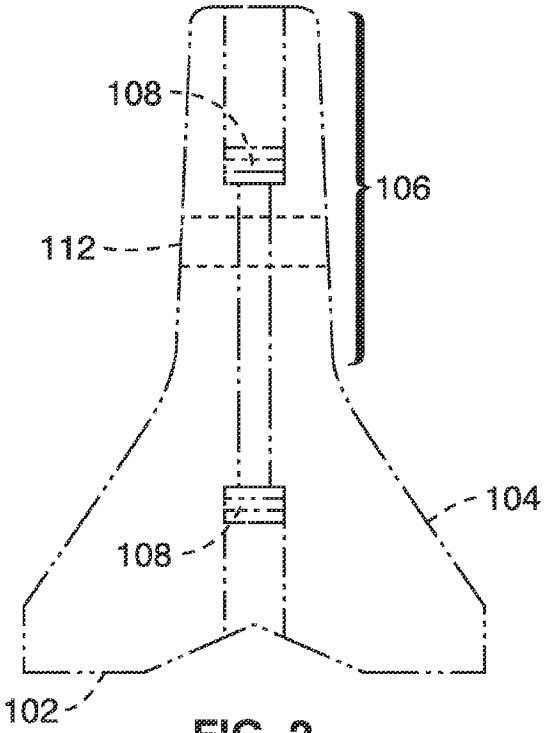
FIG. 2 (Prior Art)
FIG. 2 is an end view of the prior art traffic barrier of FIG. 1.

Traffic barriers are generally structures that are designed to prevent vehicles from leaving the roadway and colliding with obstructions or entering opposing lanes of traffic and thereby causing head on collisions. Traffic barriers can also be used to protect pedestrian zones or work zones from the risk of errant traffic. Temporary barriers or semi-permanent barriers are utilized extensively to reroute traffic and to protect highway construction workers or pedestrians. Traffic barrier sections may also be placed across a roadway to create a complete barrier to some or all traffic flow.

The Jersey Barrier or K-Rail barrier is a modular concrete barrier that was developed to divide lanes of traffic and keep vehicles within a designated roadway. These temporary concrete traffic barriers are designed to minimize damage to a vehicle due to incidental contact with the traffic barrier while preventing traversal of the barrier wall.

The typical Jersey Barrier is made from steel reinforced concrete with a vertical height of about 32 inches and a section length of about 20 feet. Jersey Barrier sections normally weigh approximately 8000 pounds and require the assistance of machines to move and place the sections at desired locations. Transportation of traffic barrier sections can be accomplished by large trucks. The traffic barrier sections can be placed and connected through stakes or cables for more permanent placements and to reduce lateral movement of the traffic barriers upon impact.

The side walls of the traffic barrier slope at an angle from a broader base to a near vertical wall around the middle of the traffic barrier. A tire engaging the lower part of the traffic barrier wall at a shallow angle will tend to ride up the traffic barrier wall which gradually lifts the vehicle, causing it to pivot away from the wall. This generally causes the vehicle to maintain its direction of travel and not cross the traffic barrier.

Variations of the Jersey Barrier include the constant slope barrier, the F-shape barrier, and the Ontario Tall Wall. The F-shape barrier has a cross section similar to the Jersey Barrier; however, the slope break point of the F-shape barrier is about three inches lower than the Jersey Barrier. The lower height of the slope break point of the angled walls reduces the vehicle lift and is considered to be safer for impacts by some vehicles. The constant slope type traffic barrier has a single slope profile with a wall slope of between 9 degrees and 10 degrees from vertical.

An alternative to portable concrete traffic barriers for short term applications are hollow polyethylene traffic barriers that are filled with ballast after they are positioned at a desired location. The polyethylene traffic barrier sections are lightweight and can be transported easily. The sections are filled with water, sand, soil or even concrete on site after placement. However, these types of ballast filled traffic barriers may not redirect a vehicle upon impact, and may be permanently damaged by an impact.

Both the Jersey Barrier and K-Rail have angled walls rising from the base that may not be clearly visible to the driver of an automobile travelling generally parallel to the traffic barrier. However, the top section of wall is generally visible to a driver, and judgments regarding spacing between the vehicle and the wall by the driver are naturally made based on the visible top part of the wall. The driver may inadvertently impact the traffic barrier base or angled walls while believing that sufficient space remains between the vehicle and the wall because the base extends further out into the traffic lane than the top of the wall. Unintended slight impacts with the traffic barrier base may lead to tire damage and over-correction maneuvers by a driver.

Figure 1:
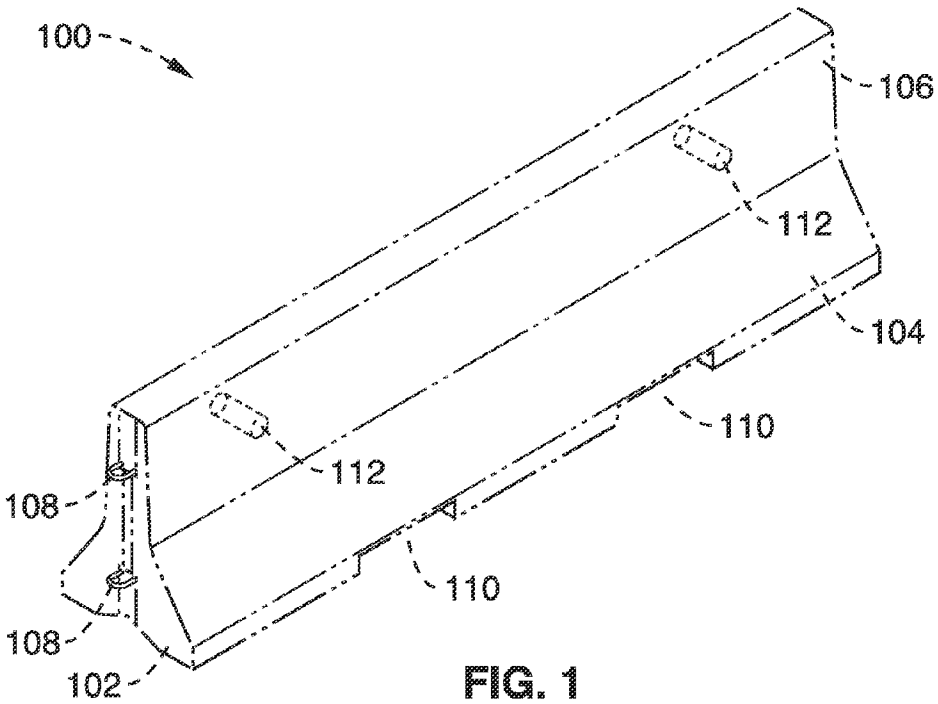
FIG. 1 (Prior Art)
FIG. 1 is a perspective view of one section of a prior art conventional traffic barrier.

Refer now to FIG. 1 and FIG. 2, where a conventional K-Rail or Jersey style traffic barrier section is shown. A traffic barrier 100 section has a base 102 with sidewalls with a taper 104 transitioning to vertical section 106 generally within 0-20 degrees of vertical. In the embodiment shown, the traffic barrier section has loops 108 that can be used to couple one section to a second section and a support stake driven into the ground or asphalt to reduce lateral barrier movement in the event of a vehicle impact.

The traffic barrier 100 shown in FIG. 1 also has one or more fork pockets 110 or scuppers to allow a fork lift to easily engage the traffic barrier section for removal from the truck or transportation and placement to a designated position. The typical traffic barrier 100 also has at least two horizontally transverse lifting holes 112 in the vertical section 106 of the traffic barrier 100. The transverse lifting holes 112 are normally four to six inches in diameter and are configured to engage a tubular lifting member or to pass a cable for placement by a crane or other lifting arm.

Traffic Barrier Delineators

Figure 3:
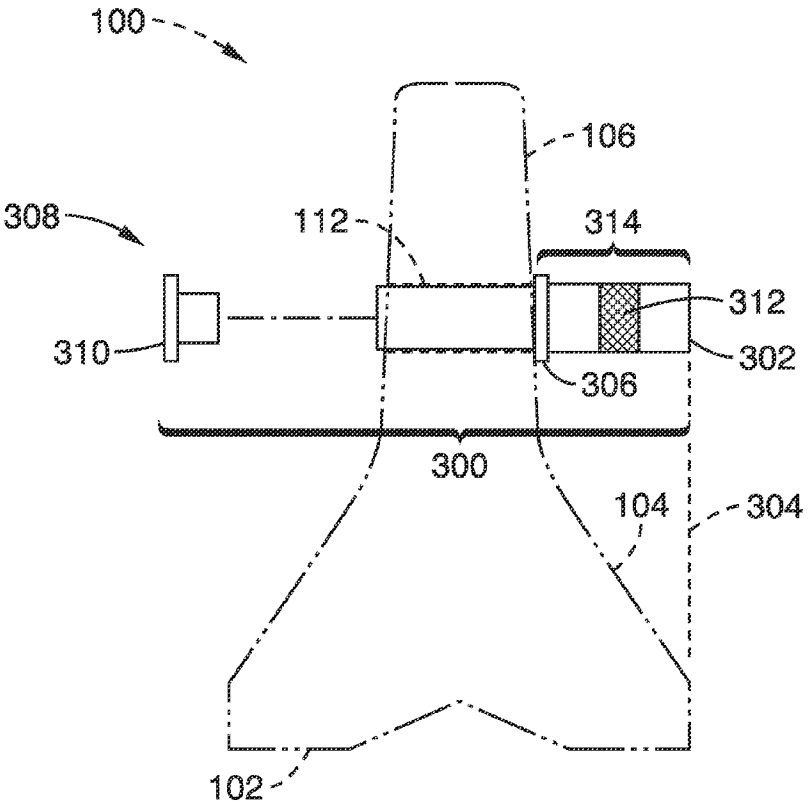
FIG. 3 is an end view of the traffic barrier of FIG. 1, where the traffic barrier is supporting a traffic side installed two-piece embodiment of a barrier delineator apparatus according to the invention that supplies visual cues on one side of the traffic barrier.

Refer now to FIG. 3. Here, the transverse lifting holes 112 in the traffic barrier are used to support a traffic barrier delineator according to various embodiments of the invention. In the embodiment shown in FIG. 3, a traffic barrier delineator 300 has a generally cylindrical body 302 that is sized to fit within a lifting hole 112. While a cylindrical-shaped or tubular-shaped body 302 is preferred, the cross-sectional shape of the body can be square, triangular, pentagonal or other regular or irregular shape provided that it fits within lifting hole 112.

The body 302 is preferably made from a durable material such as plastic or rubber that is flexible so that glancing impacts with a vehicle will not damage the vehicle or the body 302 of the traffic barrier delineator apparatus 300. Such flexible materials will also return to their original shape and position after being bent.

As shown in FIG. 3, the body 302 is inserted into the lifting hole 112 and positioned so that the distal (traffic side) end of the body 302 approximately meets a vertical line 304 extending from the outside edge of the traffic barrier base 102 as illustrated. As means for securing the body 302 to the traffic barrier 100, an optional retainer ring 306 may be molded into the body 302 or slipped over and affixed to the body 302 to assist in the installation process as an indicator of the length 314 of the body 302 that must remain outside of the lifting hole 112. In one embodiment, the ring 306 may also be a sleeve (not shown) that fits into the lifting hole 112. In one embodiment, an indicator line (not shown here) would be marked on (or molded into) the exterior surface of the body 302.

In one embodiment, the body 302 is reversibly secured in the lifting hole 112 by frictional engagement of the outer surface of the body 302 with the inner surface of the lifting hole 112.

In one alternative embodiment, the proximal (non-traffic side) end of the body 302 is configured to receive an optional end cap 308 that has a larger diameter portion 310 than that of the diameter of the lifting hole 112. The optional end cap 308 attaches to the proximal end of body 302 and may secure the body 302 within the lifting hole 112 of the traffic barrier 100.

Although it may be preferred that the body 302 be disposed within a lifting hole 112 of a traffic barrier 100, it will be understood that the traffic barrier delineator 300 could be secured directly to the traffic barrier 100 rather than disposed in a lifting hole 112. For example, the body 302 could have a base that is coupled to the traffic barrier 100 with an adhesive (not shown here), or other permanent or removable mechanical attachment.

The body 302 preferably has one or more reflective strips 312 on its outer surface 302 to reflect the beam of a headlight or the sun. The body 302 may also be painted partially or completely with reflective paint in another embodiment. In still another embodiment, the body 302 may be formed of a fluorescent material.

Figure 4:
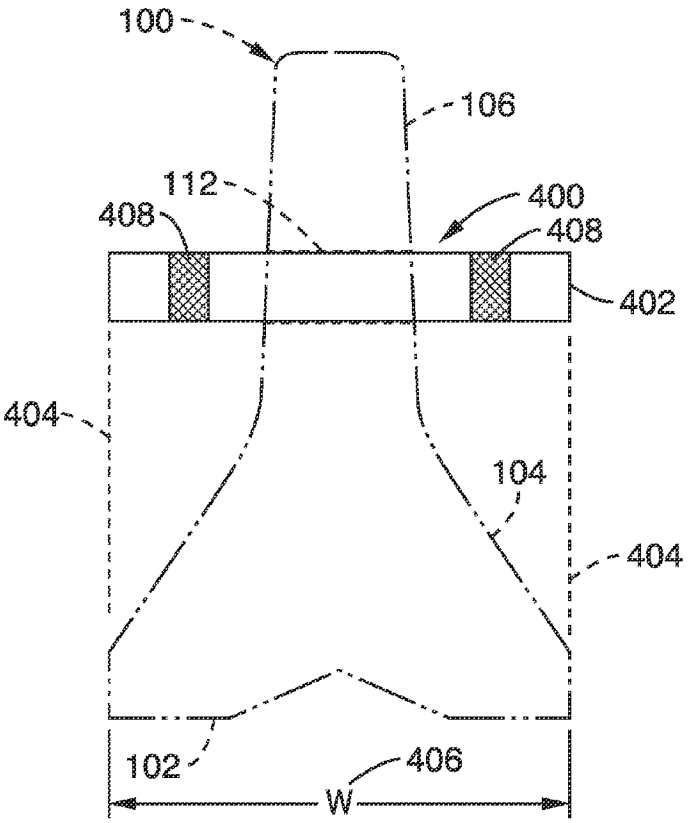
FIG. 4 is an end view of the traffic barrier of FIG. 1, where the traffic barrier is supporting a one-piece embodiment of a barrier delineator apparatus according to the invention that supplies visual cues to both sides of the traffic barrier.

Referring now to FIG. 4, an alternative embodiment of the traffic barrier delineator is shown for use on central medians with traffic flowing on both sides of the traffic barrier 100. Here, a traffic barrier delineator 400 has a body 402 that is sized with a diameter that allows the body to slide through and frictionally engage the lifting hole 112. Additionally, the body 402 preferably has a length that allows the ends of the body to approximately meet the vertical lines 404 extending from the outside edges of the traffic barrier base 102 as illustrated. In other words, the length of body 402 is approximately the same as the full cross-sectional width W 406 of the base 102 of the traffic barrier 100. In the typical traffic barrier 100, the width of the base 102 is approximately 2 feet.

The body 402 preferably has one or more reflectors 408 or reflective strips mounted on the exterior surface of the body 402. The reflectors 408 may be on any part of the body 402, but reflectors 408 or strips mounted on the ends or near the ends of the body 402 are preferred as providing improved information to drivers about the width of the traffic barrier 100 base 102.

In yet another set of alternative embodiments, the body 302 of FIG. 3 and the body 402 of FIG. 4 may have light emitting diodes (LEDs) or other lights mounted within the body (respectively 302 and 402) or on the outer surface of the body to artificially illuminate the traffic barrier delineator (respectively 300 and 400). The lights may flash with a desired repetition rate or be on constantly. The lights may be battery powered or powered by a generator or from a public utility. The lights may also be activated or deactivated by a solar switch or by other sensors.

Figure 5:
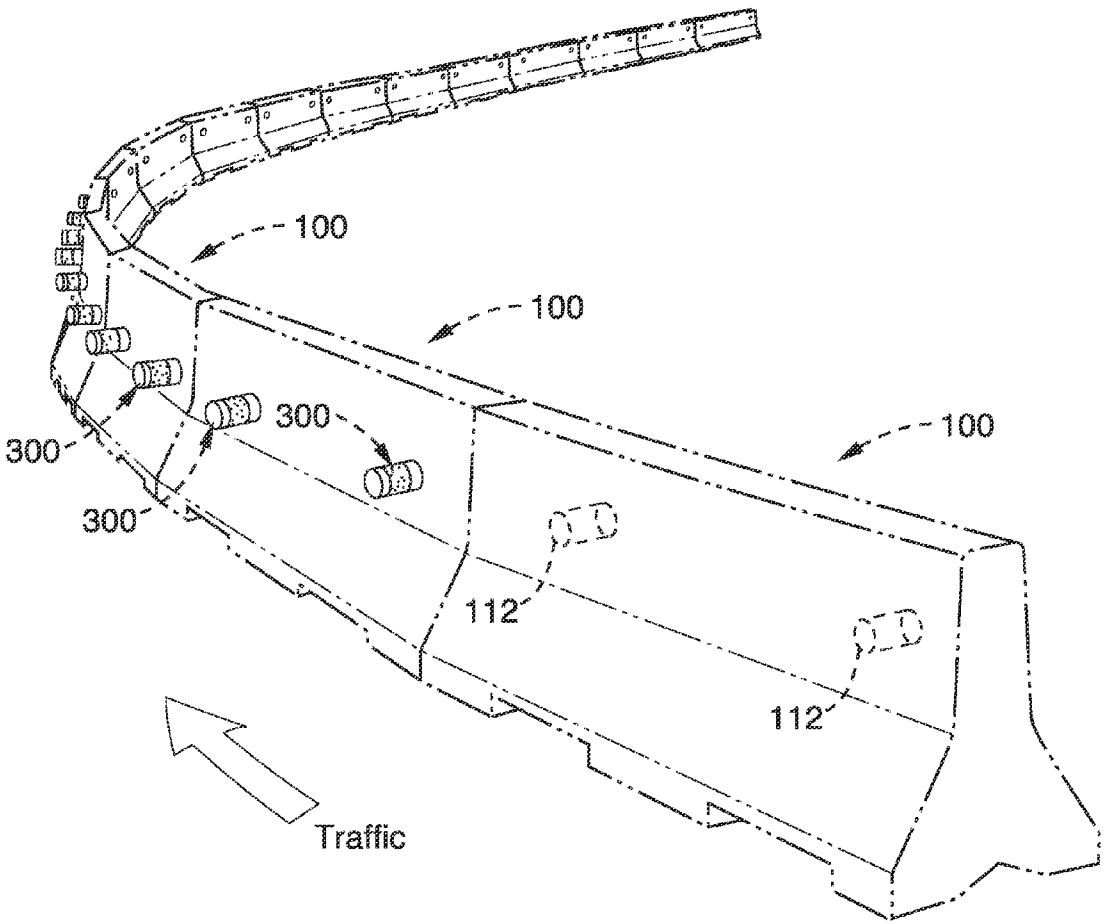
FIG. 5 is a perspective view of a series of the traffic barriers of FIG. 1, where the traffic barriers are supporting several instances of a traffic barrier delineator apparatus according to present invention.

Refer now to FIG. 5, which depicts a series of traffic barriers 100 adjacent to a roadway. In FIG. 5, a plurality of traffic barrier delineators 300 are shown by way of example. These traffic barrier delineators could be installed in different ways depending on whether the optional retainer ring 306 is used. In the absence of a retainer ring 306, or if one is used but is not molded to the body 302 such as in the case of a slip ring or sleeve, the body 302 could be slidably inserted through a lifting hole 112 from the non-traffic side of the barrier. On the other hand, if a molded retainer 306 is used, it would be necessary to insert the traffic barrier delineator into the lifting hole 112 from the traffic side of the barrier. In that case, the installer could either install the traffic barrier delineators while standing on the traffic side of the barrier, or the installer could stand on the side opposite from traffic and reach over the barrier. This may not be desirable if traffic is present.

Since installing the traffic barrier delineators from the non-traffic side of the barriers would provide additional protection to workers, additional embodiments have been developed specifically for installation from the non-traffic side of the barriers. Such embodiments are illustrated in FIG. 6 through FIG. 12.

Figure 6:
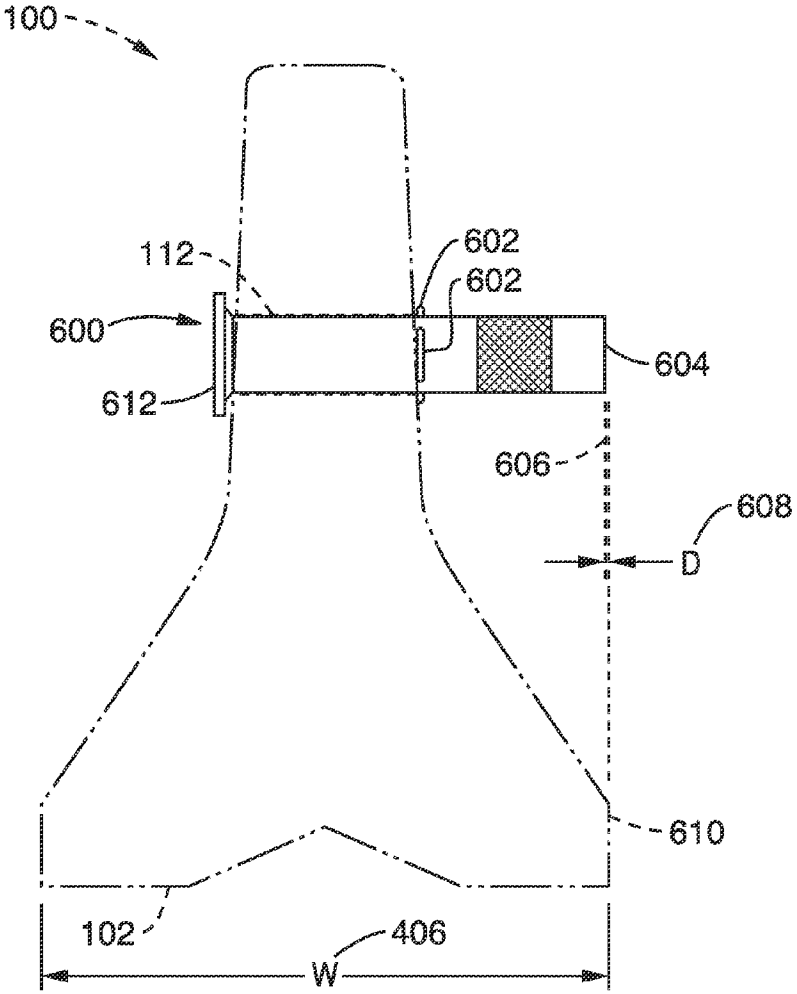
FIG. 6 is an end view of the traffic barrier of FIG. 1, where the traffic barrier is supporting a non-traffic side installed one-piece embodiment of a barrier delineator apparatus according to the invention that supplies visual cues to one side of the traffic barrier.

Refer now to FIG. 6 which shows a traffic barrier delineator 600 according to another embodiment of the present invention. In this embodiment, one or more resilient ears 602 are provided as means for securing the body 604 to the traffic barrier 100. The protruding ears 602 in this embodiment are also part of a one-piece or unitary construction. Ears 602 extend radially outward from the body 604 to a radius larger than the diameter of the lifting hole 112. This allows the diameter of the body 604 to be sized such that the body can be easily inserted though the lifting hole 112 from the non-traffic side of the barrier, but securely retained in place by the ears 602. The ears 602 compress when the body 604 is inserted through the lifting hole 112, and then expand when the ears clear the lifting hole 112 to hold the body 604 in place.

As illustrated in this figure, the body 604 extends through the lifting hole 112 and outward from the face of the traffic barrier to a point 606 that is within a distance D 608 of a vertical line extending from the edge 610 of the base 102 of the traffic barrier. This distance D 608 may be within ±25% of width W 406, more preferably within ±15% of width W 406, and most preferably within ±5% of width W 406. For a base width W 406 of twenty-four inches, those respective tolerance distances D are ±6 inches, ±3.6 inches, and ±1.2 inches.

For convenience, the proximal (non-traffic side) end of the traffic barrier delineator 600 has a larger diameter base portion 612 that also acts as a stop or end cap for insertion into a traffic barrier (e.g., traffic barrier 100 of FIG. 1), as well as acting as a self-standing base. A similar base configuration is employed with the traffic barrier delineator 700 described below. Note that the base portion also functions as further means for securing the body to the traffic barrier.

Figure 7:
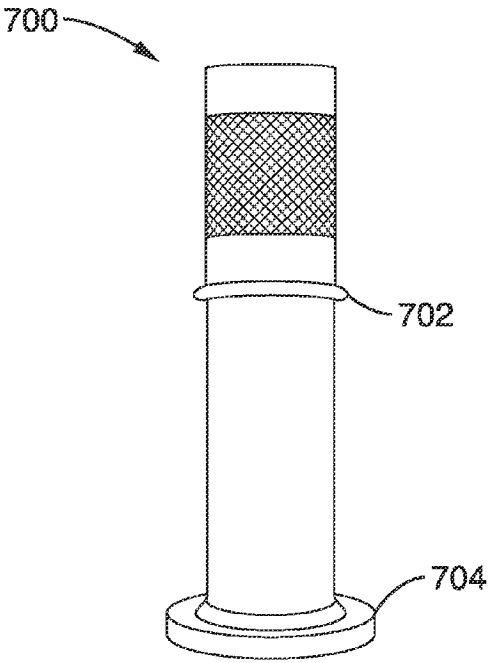
FIG. 7 is a perspective view of an alternative embodiment of the barrier delineator apparatus shown in FIG. 6.

Refer now to FIG. 7, which is a perspective view of another embodiment of a traffic barrier delineator according to the present invention. In this embodiment, the traffic barrier delineator 700 has a one-piece construction that includes an annular or ring-shaped rib 702 that acts as a means for securing the body to the traffic barrier, functioning similarly to the ears 602 described above. For convenience, the other end of the traffic barrier delineator 700 has a larger diameter base portion 704 that also acts as a stop or end cap for insertion into a traffic barrier (e.g., traffic barrier 100 of FIG. 1), as well as acting as a self-standing base. This base configuration is similar to that employed with the traffic barrier delineator 600 as illustrated in FIG. 6. Again, the base portion also functions as further means for securing the body to the traffic barrier.

Figure 8B:
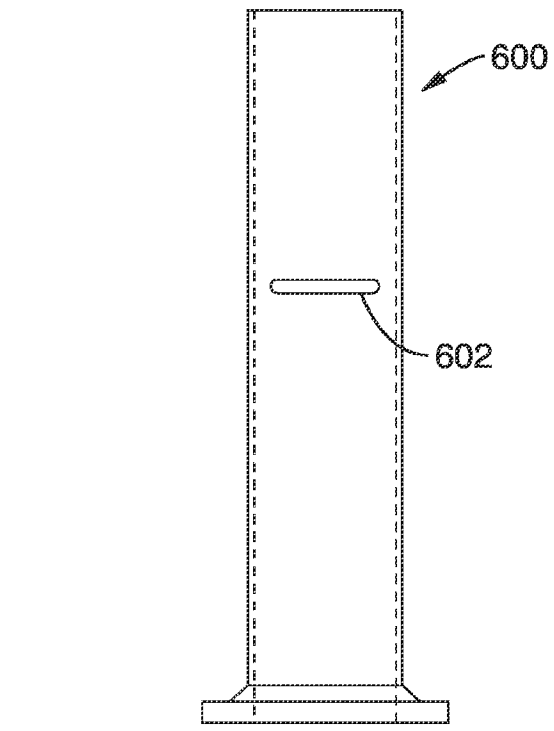
FIG. 8B is a 90 degree orthographic projection of the side view of the barrier delineator of FIG. 8A.
Figure 8A:
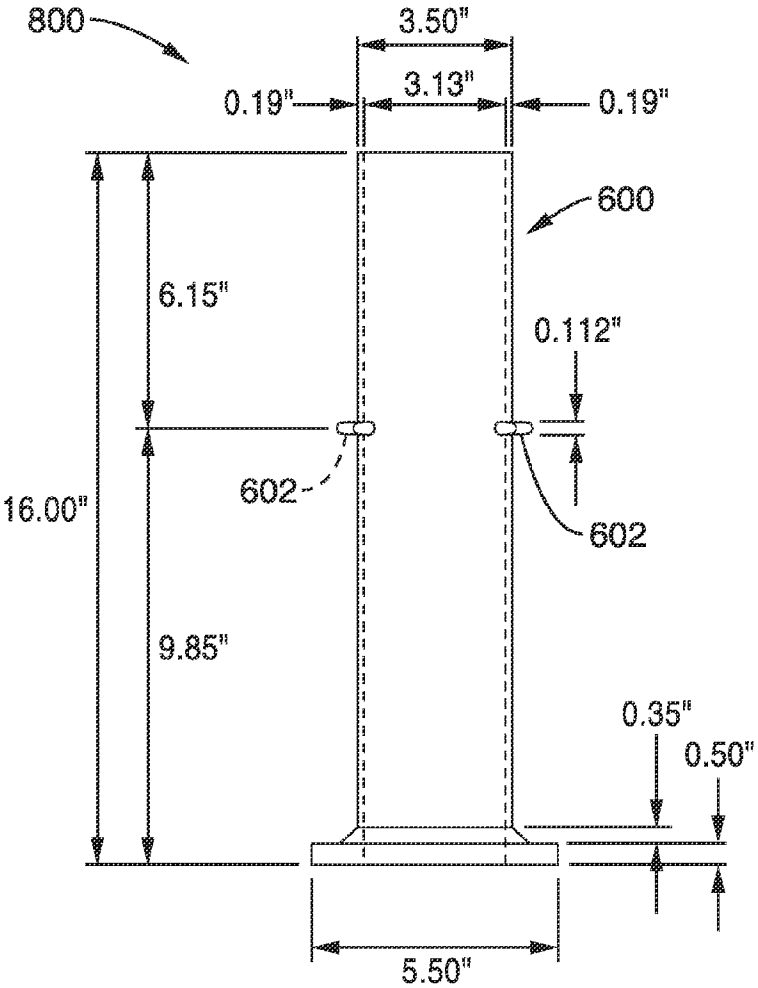
FIG. 8A is a side view of the barrier delineator apparatus shown in FIG. 6 illustrating radially projecting ears to retain the apparatus in the traffic barrier.

Refer now to FIG. 8A, which is a side view 800 of the traffic barrier delineator 600 of FIG. 6. Here, the ears 602 are shown more clearly than in FIG. 6. In these figures it can clearly be seen that the traffic barrier delineator 600 is made of a one-piece construction. The dimensions shown in FIG. 8A are by way of example, and not of limitation, for use with a typical traffic barrier. Refer also to FIG. 8B, which is a 90 degree orthographic projection 802 of the side view of The apparatus recited in FIG. 8A. Here, one of the radially projecting ears 602 is seen only for a portion of the diameter of the traffic barrier delineator 600.

Figure 10:
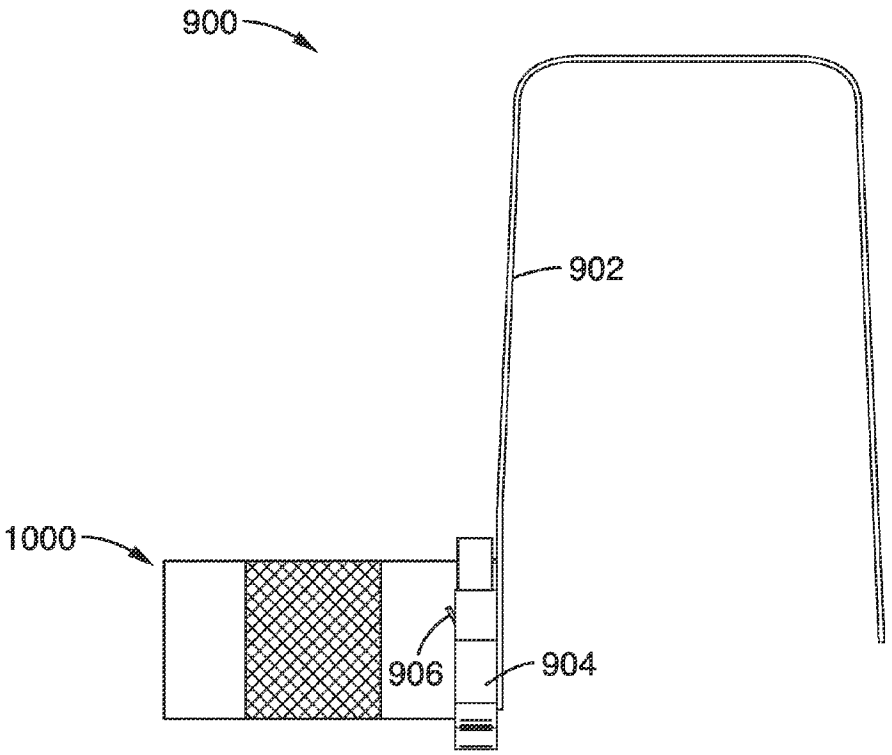
FIG. 10 is a side view of the barrier delineator hanger apparatus of FIG. 9 shown holding an embodiment of a barrier delineator apparatus according to the invention in a horizontal position.
Figure 9:
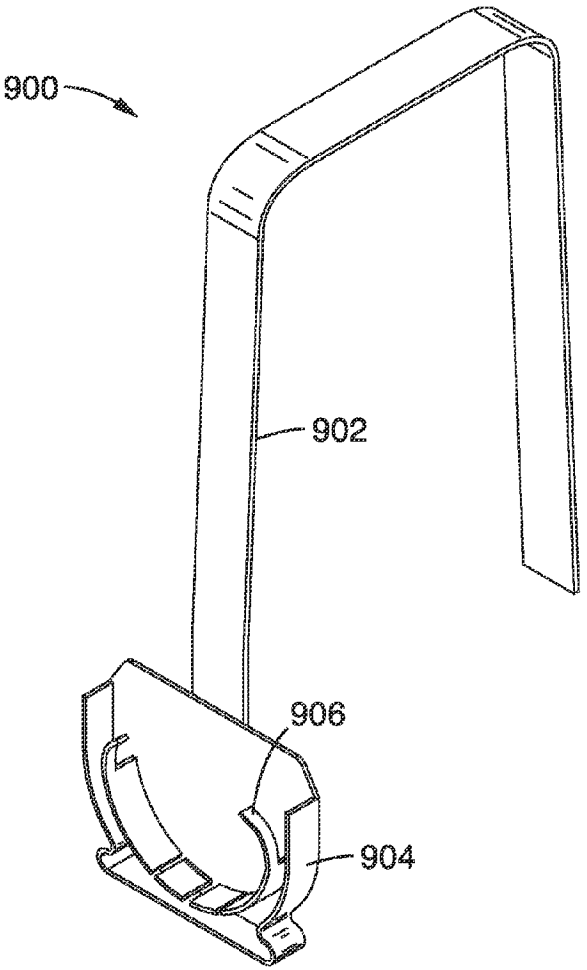
FIG. 9 is a perspective view of an embodiment of a barrier delineator hanger apparatus comprising a hanger, a mount, and a retaining clip.
Figure 11:
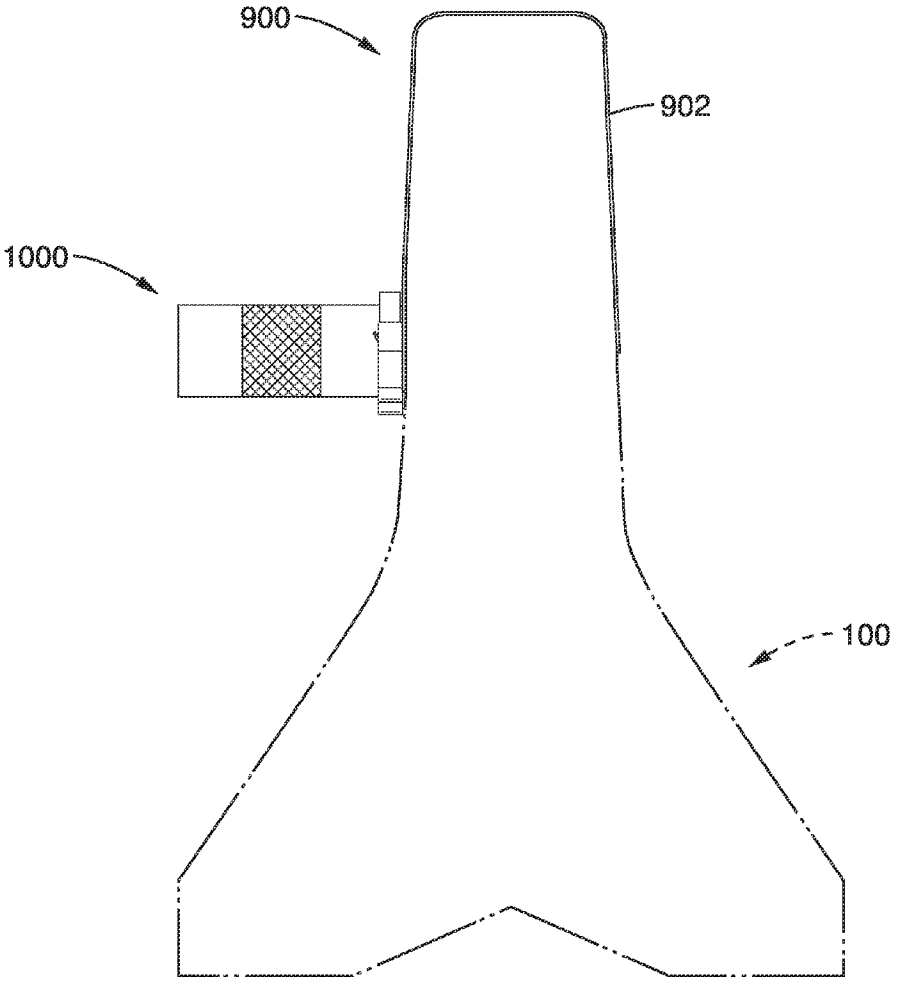
FIG. 11 is side view of the modified barrier delineator apparatus of FIG. 10 shown being held to a traffic barrier by the barrier delineator hanger apparatus of FIG. 9 and FIG. 10.

Referring now to FIG. 9, the invention also includes a traffic barrier delineator hanger apparatus 900 as an alternative means for securing the body of the traffic barrier delineator to a traffic barrier according to an embodiment of the invention. Traffic barrier delineator hanger apparatus 900 comprises a hanger 902, a mount 904, and a retaining clip 906. This embodiment allows a traffic barrier delineator to be installed on a traffic barrier where lifting holes 112 are not present, or are not available or desirable for use, or where there are an insufficient number of lifting holes. FIG. 10 shows the traffic barrier delineator hanger apparatus 900 of FIG. 9 holding a modified traffic barrier delineator 1000 in place by the mount 904 and retaining clip 906. FIG. 11 then shows the assembly of FIG. 10 attached to a traffic barrier 100 by means of placing the hanger 902 over the traffic barrier.

Figure 12:
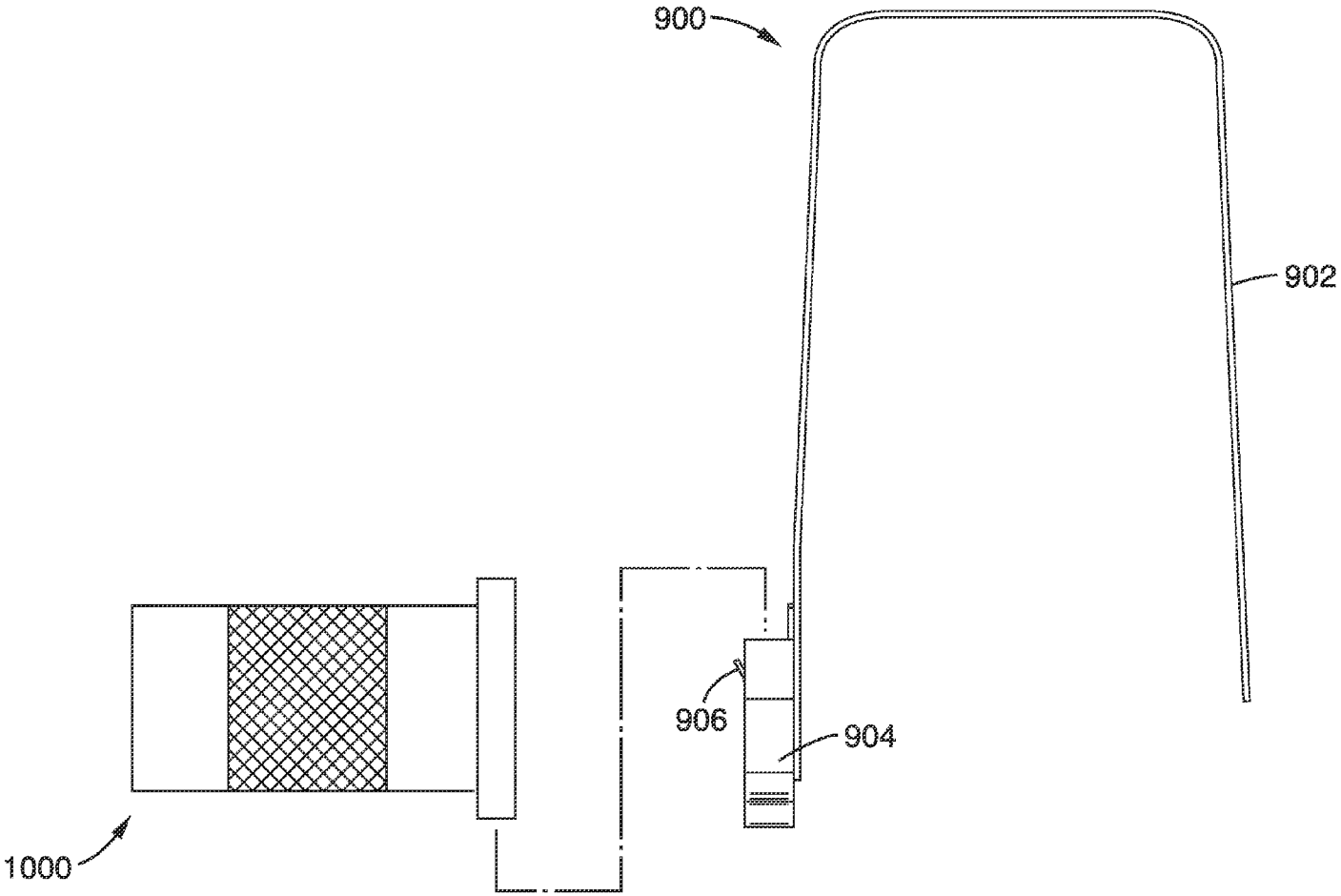
FIG. 12 is an exploded view of the assembly of FIG. 10.

FIG. 12 is an exploded view of the assembly of FIG. 10 that illustrates how the modified traffic barrier delineator 1000 is slid into the traffic barrier delineator hanger apparatus 900 of FIG. 9 by insertion into the mount 904, and retained by the retaining clip 906. Note that the traffic barrier delineator 1000 is referred to herein as "modified" because it shorter than the traffic barrier delineator 600 of FIG. 6. It will be appreciated that in this configuration the traffic barrier delineator can be shorter because it does not need to pass through a lifting hole 112.

Although not shown here, the traffic barrier delineator hanger apparatus 900 may be assembled with the modified traffic barrier delineator 1000 either before or after the traffic barrier delineator hanger apparatus 900 is emplaced on a traffic barrier 100.

The traffic barrier delineator described above is generally constructed of a very low yield strength material. The resulting collapsible and bendable traffic barrier delineator will not damage vehicles. The traffic barrier delineator is reusable in many designs. It is visually much clearer for vehicle traffic to identify the temporary traffic barrier and other lane restrictions.

Further, the ease of installing the traffic barrier delineator saves labor and the traffic barrier delineator in many designs can be removed from traffic barriers when traffic barrier movement is required. In other designs, the traffic barrier delineator may be stackable for storage.

From the discussion above it will be appreciated that the invention can be embodied in various ways, including the following:

1. A traffic barrier delineator apparatus for use with a traffic barrier of the type having a horizontal lifting hole and a base portion, the apparatus comprising: (a) an elongate body configured to be disposed in the horizontal lifting hole of the traffic barrier; and (b) the elongate body having a reflective portion; (c) wherein the body and reflective portion are configured to provide a visual indication of extension of the base portion of the traffic barrier into a roadway.

2. The apparatus of any preceding embodiment, wherein said body further comprises means for securing the body to the traffic barrier.

3. A traffic barrier delineator apparatus for use with a traffic barrier of the type having a horizontal lifting hole and a base portion having a width, the apparatus comprising: (a) an elongate body configured to be disposed in the horizontal lifting hole of the traffic barrier; (b) the elongate body having a first end and a second end; (c) the elongate body having a length approximately equal to the width of the base portion of the traffic barrier; (d) the elongate body having a first reflective portion adjacent said first end and a second reflective portion adjacent said second end; (e) wherein the body and reflective portions are configured to provide a visual indication of extension of the base portion of the traffic barrier into a roadway.

4. The apparatus of any preceding embodiment, wherein said body further comprises means for securing the body to the traffic barrier.

5. A traffic barrier delineator apparatus for use with a traffic barrier of the type having a base portion, the apparatus comprising: (a) an elongated body; (b) wherein the body comprises a reflective portion; (c) wherein the body is configured to be retained on a traffic barrier; (d) wherein the body and reflective portion are configured to provide a visual indication of extension of the base portion of the traffic barrier into a roadway.

6. The apparatus of any preceding embodiment, wherein said body further comprises means for securing the body to the traffic barrier.

7. The apparatus of any preceding embodiment, further comprising a retention system on said body configured for retaining the body in a hole in the traffic barrier.

8. The apparatus of any preceding embodiment, wherein the retention system comprises: (a) a circular flange that forms a base to the body, the circular flange comprising a diameter larger than that of the hole; and (b) a retainer disposed about a middle section of the body; (c) whereby the body is configured to be retained on one side of the hole by the circular flange, and on another side of the hole by the retainer.

9. The apparatus of any preceding embodiment, wherein the retainer is selected from a group of retainers consisting of: an ear radially extending from the body, an axisymmetric rib radially extending from the body, and a portion of the body that forms a removable interference fit with at least a portion of the hole in the traffic barrier.

10. The apparatus of any preceding embodiment, wherein the body is configured to extend horizontally from the traffic barrier.

11. The apparatus of any preceding embodiment: wherein the traffic barrier has a base with a width W; and wherein the body is configured to extend horizontally from the traffic barrier a horizontal distance D from the base of the traffic barrier.

12. The apparatus of any preceding embodiment, wherein distance D is selected from a group of distances consisting of: within ±25% of W, within ±20% of W, within ±15% of W, within ±10% of W, within ±5% of W, and within ±3% of W.

13. The apparatus of any preceding embodiment, wherein the traffic barrier delineator is configured to extend from one or both sides of the traffic barrier.

14. The apparatus of any preceding embodiment, wherein the traffic barrier delineator is configured to extend from a traffic barrier delineator hanger apparatus, the traffic barrier delineator hanger apparatus comprising: (a) a hanger configured to be removably attached to the traffic barrier; (b) a base disposed on one distal end of the hanger; and (c) a retention clip built into the base; (d) whereby the retention clip is configured to retain a modified traffic barrier delineator; and (e) wherein the modified traffic barrier delineator comprises a body that is shorter than a traffic barrier delineator configured to pass through a hole in the traffic barrier.

15. A traffic barrier delineator apparatus for use with a traffic barrier of the type having a horizontal lifting hole and a base portion having a width, the apparatus comprising: (a) an elongate body with a length approximately equal to the width of the base portion of the traffic barrier, the body configured to be disposed in the horizontal lifting hole of the traffic barrier; and (b) one or more reflective portions on the elongate body; (c) wherein a proximal end and a distal end of the elongate body are configured to be positioned equally distant from a center of the traffic barrier; and (d) wherein the body and the reflectors are configured to provide a visual indication of extension of the base portion of the traffic barrier into a roadway.

16. The apparatus of any preceding embodiment, wherein said body further comprises means for securing the body to the traffic barrier.

17. The apparatus of any preceding embodiment, wherein said means for securing the body to the traffic barrier comprises an end cap affixed to the body.

18. The apparatus of any preceding embodiment, wherein one or more of the reflective portions on the elongate body further comprise a distance indicator on an exterior surface of the body.

19. The apparatus of any preceding embodiment, wherein the distance indicator comprises a ring disposed circumferentially around the body.

20. The apparatus of any preceding embodiment, wherein said body further comprises means for illuminating the body.

21. The apparatus of any preceding embodiment, wherein said body further comprises one or more lights disposed on the exterior surface of the body and a power source configured to power one or more of the lights.

22. A single piece traffic barrier delineator apparatus, comprising: (a) a body having two ends and a middle region; (b) an end cap comprising a flange on one of the body ends; and (c) a retainer disposed in the middle region; (d) said retainer configured for securing the body to a traffic barrier; (e) said body configured to provide a visual indication of extension of a base portion of the traffic barrier into a roadway.

23. The apparatus of any preceding embodiment, wherein the retainer is selected from a group of retainers consisting of: an ear radially extending from the body, an axisymmetric rib radially extending from the body, and a portion of the body that forms a removable interference fit with at least a portion of a hole in a traffic barrier.

24. A method of installing a traffic barrier delineator apparatus, the method comprising: (a) providing a traffic barrier, the traffic barrier comprising one or more holes; (b) providing a traffic barrier delineator apparatus, the apparatus comprising: (i) a body having two ends and a middle region; (ii) an end cap comprising a flange on one of the body ends; and (iii) a retainer disposed in the middle region; and (c) sliding the body into one of the holes from the end opposite the end cap, until the end cap touches the traffic barrier.

25. The method of any preceding embodiment, further comprising sliding the traffic barrier delineator into the traffic barrier from a side of the traffic barrier that the end cap ultimately touches.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A traffic barrier with base delineator apparatus, the apparatus comprising:

(a) a traffic barrier segment having a base portion with an outside edge, the traffic barrier segment having a vertical section extending from the base portion, the vertical section having a sidewall with one or more horizontally transverse lifting holes, the traffic barrier segment having a traffic side and a work side, the traffic barrier segment configured for positioning with additional traffic barrier segments to form a traffic barrier;

(b) a resilient, elongate body having a proximal end and a distal end, said elongate body having a width sized to fit within an interior of one of said horizontally transverse lifting holes, said elongate body having a length sized to be greater than the length of said transverse lifting hole, said elongate body having a base mounted to the proximal end of the body;

(c) wherein said elongate body has an exterior surface configured to frictionally engage the interior surface of said transverse lifting hole upon insertion of the elongate body into the transverse lifting hole;

(d) wherein the elongate body can be slidably inserted and removed from the barrier without tools;

(e) wherein the elongate body can be slidably inserted and removed safely from the work side of the barrier without stopping traffic on the traffic side of the barrier; and (f) an annular restraint on the exterior surface of said elongate body, said restraint configured to resist removal of the elongate body from the barrier lifting hole after insertion.

2. The apparatus as recited in claim 1, further comprising at least one reflector mounted to the exterior surface of the distal end of the elongate body.

3. The apparatus as recited in claim 1, wherein said annular restraint comprises a resilient annular ridge.

4. The apparatus as recited in claim 1, wherein said annular restraint comprises a plurality of resilient ears extending radially from said exterior surface of said elongate body.

5. The apparatus as recited in claim 1, wherein said elongate body comprises a flexible rubber tube.

6. A traffic barrier with base delineator apparatus, the apparatus comprising:

(a) a traffic barrier segment having a base portion with an outside edge, the traffic barrier segment having a vertical section extending from the base portion, the vertical section having a sidewall with one or more horizontally transverse lifting holes, the traffic barrier segment having a traffic side and a work side, the traffic barrier segment configured for positioning with additional traffic barrier segments to form a traffic barrier;

(b) a resilient, elongate body having a proximal end and a distal end, said elongate body having a width sized to fit within an interior of one of said horizontally transverse lifting holes, said elongate body having a length sized to be greater than the length of said transverse lifting hole, said elongate body having a base mounted to the proximal end of the body;

(c) wherein said elongate body has an exterior surface configured to frictionally engage the interior surface of said transverse lifting hole upon insertion of the elongate body into the transverse lifting hole;

(d) wherein the elongate body can be slidably inserted and removed from the barrier without tools;

(e) wherein the elongate body can be slidably inserted and removed safely from the work side of the barrier without stopping traffic on the traffic side of the barrier; and (f) an annular ring adapted to slide over the exterior surface of the distal end of the elongate body after the elongate body is inserted into a said one of said transverse lifting holes.

7. The apparatus as recited in claim 6, wherein said elongate body comprises a flexible rubber tube.

8. The apparatus as recited in claim 6, further comprising at least one reflector mounted to the exterior surface of the distal end of the elongate body.

9. A traffic barrier with base delineator apparatus, the apparatus comprising:

(a) a traffic barrier segment having a base portion with an outside edge, the traffic barrier segment having a vertical section extending from the base portion, the vertical section having a sidewall with one or more horizontally transverse lifting holes, the traffic barrier segment having a traffic side and a work side, the traffic barrier segment configured for positioning with additional traffic barrier segments to form a traffic barrier; and (b) a resilient, elongate body having a proximal end and a distal end, said elongate body having a width sized to fit within an interior of one of said horizontally transverse lifting holes, said elongate body having a length sized to be greater than the length of said transverse lifting hole, said elongate body having a base mounted to the proximal end of the body;

(c) wherein said elongate body has an exterior surface configured to frictionally engage the interior surface of said transverse lifting hole upon insertion of the elongate body into the transverse lifting hole;

(d) wherein the elongate body can be slidably inserted and removed from the barrier without tools;

(e) wherein the elongate body can be slidably inserted and removed safely from the work side of the barrier without stopping traffic on the traffic side of the barrier; and (f) wherein said base of said elongate body comprises an end cap reversibly mounted to the proximal end of said elongate body.

10. The apparatus as recited in claim 9, wherein said elongate body comprises a flexible rubber tube.

11. The apparatus as recited in claim 9, further comprising at least one reflector mounted to the exterior surface of the distal end of the elongate body.

* * * * *